US005195138A

United States Patent [19]

Kane et al.

[11] Patent Number: 5,195,138

[45] Date of Patent: Mar. 16, 1993

[54] VOICE SIGNAL PROCESSING DEVICE

[75] Inventors: Joji Kane, Nara; Akira Nohara, Nishinomiya, both of Japan

[73] Assignee: Matsushita Electric Industrial Co., Ltd., Japan

[21] Appl. No.: 637,203

[22] Filed: Jan. 3, 1991

[30] Foreign Application Priority Data

| | | | |
|---|---|---|---|
| Jan. 18, 1990 | [JP] | Japan | 2-008592 |
| Jan. 18, 1990 | [JP] | Japan | 2-008595 |
| Jan. 26, 1990 | [JP] | Japan | 2-017348 |
| Feb. 6, 1990 | [JP] | Japan | 2-026506 |
| Feb. 6, 1990 | [JP] | Japan | 2-026507 |
| Feb. 14, 1990 | [JP] | Japan | 3-034297 |

[51] Int. Cl.[5] ..... G10L 5/00

[52] U.S. Cl. ..... 381/46; 381/43

[58] Field of Search ..... 381/43, 46; 395/2

[56] References Cited

U.S. PATENT DOCUMENTS 4,239,936 12/1980 Sakoe .

FOREIGN PATENT DOCUMENTS 8807739 10/1988 World Int. Prop. O. .

OTHER PUBLICATIONS

The Journal of the Acoustical Society of America, vol. 78, No. 5, Nov. 1985, pp. 1671-1674, J. T. Sims.

The Journal of the Acoustical Society of America, vol. 41, No. 2, 1967, pp. 293-309, A. M. Noll.

Nachrichtentechnische Zeitschrift (NTZ) vol. 26, No. 7, pp. 312-316, Timme et al.

*Primary Examiner*—Emanuel S. Kemeny

*Attorney, Agent, or Firm*—Beveridge, DeGrandi, Weilacher

[57] ABSTRACT

A cepstrum calculating device obtains a cepstrum of a voice signal and a mean-value calculation device cepstrum means output. A threshold setting device sets a voice detection threshold level on the basis of the cepstrum mean-value output. A cepstrum addition section adds a cepstrum value exceeding the cepstrum mean-value. A comparator compares the cepstrum output from the cepstrum addition section with the threshold output signal from the threshold setting device, thereby to output a voice-detection signal.

11 Claims, 15 Drawing Sheets

VOICE SIGNAL PROCESSING DEVICE

BACKGROUND OF THE INVENTION

1. Field of the Invention

The present invention relates to a voice signal processing device with respect to voice detection and voice recognition techniques.

2. Description of the Invention

Recently, voice detection devices for detecting the presence/absence of a voice have been widely used for applications such as voice recognition, speaker recognition, equipment operation by voice, and input to computer by voice.

FIG. 1 is a block diagram showing a prior art voice detection device, whose configuration and operation will be explained hereinafter. A power detection section 19 detects a power value in an input signal to render the value to be compared by a comparator 21, and then the comparator 21 compares the value with a predetermined set value of a threshold setting section 20 to output a voice-detected signal when the value is larger than the predetermined set value.

According to the prior art voice detection device as described above, however, even if a voice input is small, when the input signal contains a noise other than the voice, a power detected by the power detection section 19 larger than the set value of the threshold setting section 20, causes the voice-detected signal to be outputted, thereby developing an inconvenience of frequent erroneous detections.

SUMMARY OF THE INVENTION

The present invention intends to detect accurately voice by utilizing cepstrum analysis.

A signal detection device of the present invention comprises;

cepstrum calculating means for obtaining a cepstrum of a voice signal, mean-value calculation means for making equal the cepstrum output from the cepstrum calculating means;

threshold setting means for setting a voice detection threshold level on the basis of the cepstrum mean-value output from the mean-value calculation means, and voice detection means to which the cepstrum mean-value output from the mean-value calculation means, the cepstrum output from the cepstrum calculating means and the threshold output signal from the threshold setting means are supplied and which detects a voice With a configuration according to the present invention, cepstrum calculation means calculates a cepstrum value of an input signal to obtain the calculated signal and a cepstrum mean-value signal by the calculated signal. Then a voice detection is performed on the basis of a signal exceeding the cepstrum mean-value signal, and controlled by a threshold signal calculated and set by the cepstrum mean-value signal.

The present invention intends to offer such device that the processing time for getting a cepstrum peak is short.

A signal detection device of the present invention comprises;

cepstrum calculating means for calculating a cepstrum of voice input, peak detection means for detecting a peak of the cepstrum output from the cepstrum calculating means, analysis interval setting means for setting an analysis interval on the basis of the peak-detected output from the peak detection means and an operation mode setting signal, and voice detection means to which the peak-detected output from the peak detection means is supplied, for detecting voice, the peak detection interval of the peak detection means being controlled by the set output from the analysis interval setting means With a configuration according to the present invention, cepstrum calculation means calculates a cepstrum of a voice input to supply the cepstrum to peak detection means. The peak detection means detects a peak of the cepstrum from the cepstrum calculation means at an analysis interval indicated by analysis interval setting means to supply the peak to voice detection means. The voice detection means compares the peak from the peak detection means with a predetermined threshold to detect a voice. An operation mode and part of the peak-detected output from the peak detection means are inputted into the analysis interval setting means. In one mode of the operation mode, the analysis interval setting means outputs a predetermined analysis interval to the peak detection means, and at the same time sets an analysis interval to output under another operation mode in response to the peak-detected output. In another operation mode, the analysis interval setting means operates in a manner to direct the analysis interval set in the former operation mode to the peak detection means, thereby reducing analysis interval and shortening processing time.

The present invention intend to realize a similar object as above.

A signal detection device of the present invention comprises;

cepstrum calculating means for calculating a cepstrum input of voice input, peak detection means for detecting a peak of the cepstrum output from the cepstrum calculating means, interval data setting means for setting a quefrency interval to be analyzed, on the basis of the peak-detected output from the peak detection means, a first memory group to which the set output from the interval data setting means is supplied through a first switch, a second memory group for setting previously interval data, a second switch for selecting the memory output from the plurality of memory groups, control means for controlling the first and second switches, and voice detection means to which the peak-detected output from the peak detection means is supplied, for detecting voice, the peak detection interval of the peak detection means being controlled by the output from one of the memory groups, selected by the second switch.

With a configuration according to the present invention, in response to an operation mode, a control section controls whether a quefrency analysis interval directed to a peak detection section is to be obtained from a first memory or second memory, and controls whether the data from an interval setting section is to be stored or not in the first memory. In one operation mode, the control section operates in such a manner that a quefrency analysis interval from the second memory is directed to the peak detection section, and a quefrency analysis interval in response to a voice input is supplied from the interval setting section to and stored in the first memory. In another operation mode, the control section operates in such a manner that a quefrency analysis interval from the first memory is directed to the peak detection section, thereby allowing the processing time to be shortened.

The present invention intends to realize a similar object as above.

A signal processing device of the present invention comprises;

a cepstrum calculation section for inputting therein a voice and calculating a cepstrum, a peak detection section for detecting a peak at a specified analysis interval, from the cepstrum, a voice detection section for obtaining a voice-detected output from the peak-detected output, an analysis interval setting section for calculating an optimum analysis interval on the basis of the peak-detected output and directing the specified analysis interval to the peak detection section, an analysis interval memory for storing an analysis interval information, and an analysis interval classification section for classifying an analysis interval on the basis of the optimum analysis interval and storing the classified analysis inteval in the analysis interval memory, the analysis interval directed by the analysis interval setting section to the peak detection section, being to be directed by the analysis interval classification section in response to a mode setting input, and the analysis interval classification section checking the optimum analysis interval against the contents of the analysis interval memory in response to the mode setting input, to direct an analysis interval on the basis of the checked result to the analysis interval setting section.

With a configuration according to the present invention, a cepstrum calculation section calculates a cepstrum of a voice input, and supplies the cepstrum to a peak detection section. The peak detection section detects a peak of the cepstrum supplied from the cepstrum calculations section in accordance with an analysis interval inputted from an analysis interval setting section. Then, a voice detection section detects the presence/absence of a voice from part of the signal from the peak detection section to obtain a voice-detected output. Now, the interval setting operation of the interval setting section and the classification processing operation of an analysis interval classification section are performed in the following manner. First, when a mode setting input is "REGISTRATION", the analysis interval setting section supplies a predetermined wide analysis interval to the peak detection section, and calculates an optimum analysis interval in accordance with the peak of the cepstrum for the voice input supplied from the peak detection section, to supply the optimum analysis interval to the analysis interval classification section. The analysis interval classification section compares the data of the optimum analysis interval with the data of an analysis interval stored in an analysis interval memory, and if the both data are different in class from each other, stores additionally the data of the optimum analysis interval in the analysis interval memory. Then, when a mode setting input is "RECOGNITION", the analysis interval setting section supplies the data of tan analysis interval supplied from the analysis interval memory by the direction of the analysis interval classification section, or the set value of a predetermined wide analysis interval to the peak detection section, and calculates an optimum analysis interval in accordance with the peak of the cepstrum for the voice input supplied from the peak detection section to supply the optimum analysis interval to the analysis interval classification section. The analysis interval classification section selects an analysis interval similar to the optimum analysis interval from the memory, and directs the memory to supply the selected analysis interval to the analysis interval setting section. The above-described similar analysis intervals are defined as two analysis intervals whose superimposed interval is larger than a predetermined proportion.

The present invention intends to detect accurately voice.

A signal control device of the present invention comprises;

a power calculation section for calculating a power of a signal input, a cepstrum calculation section for calculating a cepstrum of the signal input, a peak detection section for detecting a peak of the cepstrum from the cepstrum calculation section, an S/N calculation section for calculating an S/N ratio of the signal input on the basis of the output from the power calculation section and the output from the peak detection section, a signal detection section for detecting the presence/absence of a signal input on the basis of the output of the peak detection section, and control means for controlling outputting of the signal input by a logical product of the output from the S/N calculation section and the output from the signal detection section.

With a configuration according to the present invention, a power calculation section calculates a power of a signal input, and a cepstrum calculation section through a peak detection section detects a peak of the calculated cepstrum. A signal detection section detects the presence/absence of a signal from the peak of the cepstrum, and when the signal is present, supplies the signal-detected signal to an AND section. Also, an S/N calculation section calculates an S/N utilizing the power of the signal input obtained by the power calculation section and the cepstrum peak from the peak detection section, and when the calculated S/N is equal to or more than a specified S/N value, supplies the calculated S/N to the AND section. The AND section operates in a manner to take a logical product of the signal from the S/N detection section and the signal of the signal detection section so as to control a switch. Accordingly, when the S/N of the signal input is good and the signal is present, the AND section operates in a manner to obtain a signal output.

The present invention intends to offer such device operating only against voice input to be recognized, by detecting accurately voice by using cepstrum analysis.

A signal processing device of the present invention comprises;

a voice analysis section for analyzing a voice input and outputting an analyzed signal, a matching section for comparing the analyzed signal with a template and outputting a recognized signal, a cepstrum calculation section for calculating a cepstrum from the voice input and outputting the cepstrum, a peak detection section for detecting a peak of the cepstrum and outputting the peak signal, a voice detection section for determining the presence/absence of a voice by the peak signal and outputting a first control signal to the matching section, a control section for outputting a second control signal to the matching section in response to a mode setting input and the peak signal from the peak detection section, and a peak-value memory for storing the peak signal; and the control section being to write the peak signal into the peak-value memory in response to the mode setting input of "SETTING", and being to compare the peak signal of the peak-value memory with the cepstrum peak signal of the voice input in response to the mode setting input of "RECOGNITION", to output the second control signal corresponding to each quefrency difference of the compared results, and the matching section being to output the recognized output according to the first control signal and the second control signal.

With a configuration according to the present invention, a cepstrum calculation section through a peak detection section detects a cepstrum peak of a voice input. Then, a voice detection section detects the presence/absence of a voice on the basis of the detected cepstrum peak and supplies a first control signal corresponding to the presence/absence of a voice to a matching section. Also, a control section, when a mode setting input is "REGISTRATION", stores the cepstrum peak signal obtained from the peak detection section in a peak value memory, and when a mode setting input is "RECOGNITION", compares the cepstrum peak signal obtained from the peak detection section with the peak value signal stored in the peak value memory and supplies a second control signal in accordance with respective quefrency difference to the matching section. Further, a voice analysis section analyzes the voice input so as to be used for the matching section, which in turn performs a matching processing of the analyzed input with a previously-registered data to obtain a recognized output. At that time, the initiation of the matching processing operation is controlled by the first and second control signals from the voice detection section and the control section. That is, the first control signal from the voice detection section, when a voice is detected, initiates the matching operation, while the second control signal from the control section initiates the matching operation where the control section determines, when a mode setting input is "RECOGNITION", that there is no difference between a quefrency of the cepstrum of the voice input and a quefrency of the peak signal previously registered in the memory when a mode setting is "SETTING".

The present invention intends to offer such device recognizing effectively against only registered input among plural inputs, by detecting accurately voice by using cepstrum.

A signal processing device of the present invention comprises; output using an analyzed output from a voice analysis section to which a voice signal is inputted, said matching section including first control signal inputting means and second control signal inputting means for controlling the recognition operation thereof;

a cepstrum calculation section for calculating a cepstrum of the voice signal;

a peak detection section for detecting a peak of the cepstrum at a specified interval and outputting the peak;

a voice detection section for outputting a first control signal corresponding to the presence/absence of the voice signal from output of the peak detection section;

an analysis interval memory;

an analysis interval processing section for directing and outputting the analysis interval to the peak detection section, and calculating an optimum analysis interval corresponding to the cepstrum peak and outputting the interval; and an analysis interval classification section for classifying an analysis interval on the basis of the optimum analysis interval and storing the interval in the analysis interval memory;

wherein the analysis interval directed to the peak detection section by the analysis interval processing section is to be directed by the analysis interval classification section in response to the mode of the mode setting input; the analysis interval classification section checking the optimum interval against the analysis interval data of the interval memory in response to the mode setting input, outputting the second control signal corresponding to the voice signal to be recognized, and classifying the analysis interval data of the interval memory and directing the analysis interval to the analysis interval processing section; wherein the first and second control signals limit the recognition processing in a manner to be performed only when a voice signal is present and to be recognized.

With a configuration according to the present invention, a cepstrum calculation section through a peak detection section detects a peak of the cepstrum of a voice input signal at an analysis interval specified by an analysis interval processing section. A voice detection section detects the presence/absence of a voice on the basis of the peak of the cepstrum, and supplies a first control signal to a matching section. At that time, an analysis interval given to the peak detection section is as shown below according to the mode of a mode setting input. First, where the mode setting input is "REGISTRATION", the analysis interval processing section supplies a predetermined analysis interval to the peak detection section, and calculates an optimum analysis interval corresponding to the cepstrum peak to output the calculated interval to an analysis interval classification section. The analysis interval classification section performs a classification processing as shown below. That is, the analysis interval classification section compares the optimum analysis interval with an analysis interval memory, and when the interval data of the memory has an analysis interval containing and superimposing the optimum analysis interval at a proportion equal to or more than a predetermined value (which is defined as a similar analysis interval), supplies the similar analysis interval through the analysis interval processing section to the peak detection section, and replaces the analysis interval of the memory with an analysis interval composed as described below, for storing; while when the interval data of the memory has no similar analysis interval, the analysis interval classification section writes the optimum analysis interval into the analysis interval memory. The composed analysis interval contains the optimum analysis interval and a superimposed portion of the analysis interval given by the memory data, and the lower limit and upper limit of the composed analysis interval are within either of the analysis intervals described above. The, where the mode setting input is "RECOGNITION", the analysis interval processing section supplies a predetermined analysis interval to the peak detection section, and calculates an optimum analysis interval corresponding to the peak to output the calculated interval to the analysis interval classification section. The analysis interval classification section compares the optimum analysis interval with the analysis interval memory. At that time, when the analysis interval similar to the optimum analysis interval exists in the memory, the classification section supplies the analysis interval of the memory through the analysis interval processing section to the peak detection section, and outputs the second control signal corresponding to the signal to be recognized; while when no such interval exists in the memory, the predetermined analysis interval is held as it is for the analysis interval of the peak detection section.

On the other hand, a voice analysis section analyzes the voice input corresponding to the analysis processing of a matching section, which in turn performs a matching processing of the analyzed input data with a previously-registered data to obtain a recognized output. At that time, the matching processing section is controlled such that the processing is performed only when the first and second control signals correspond to the voice signal presence and the signal to be recognized, respectively.

PREFERRED EMBODIMENTS OF THE INVENTION

Referring to drawings, an embodiment of the present invention will be explained hereinafter.

Figure 1:
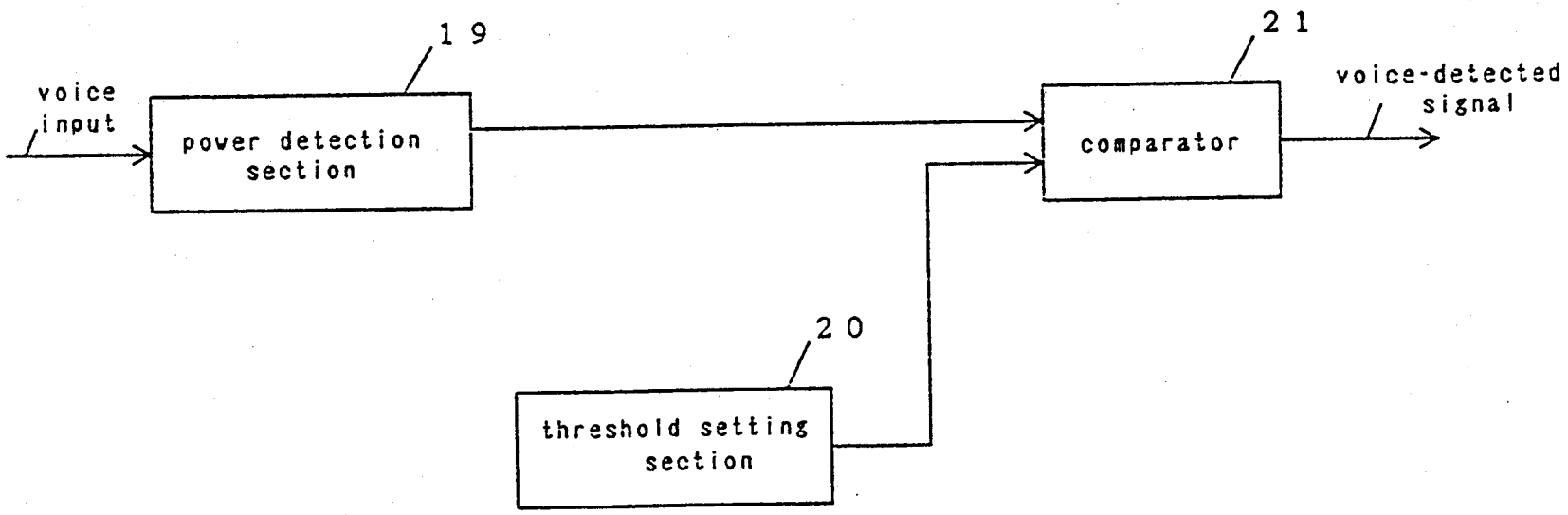
FIG. 1 (PRIOR ART)
FIG. 1 is a block diagram of a voice detection device of a prior art.
Figure 2:
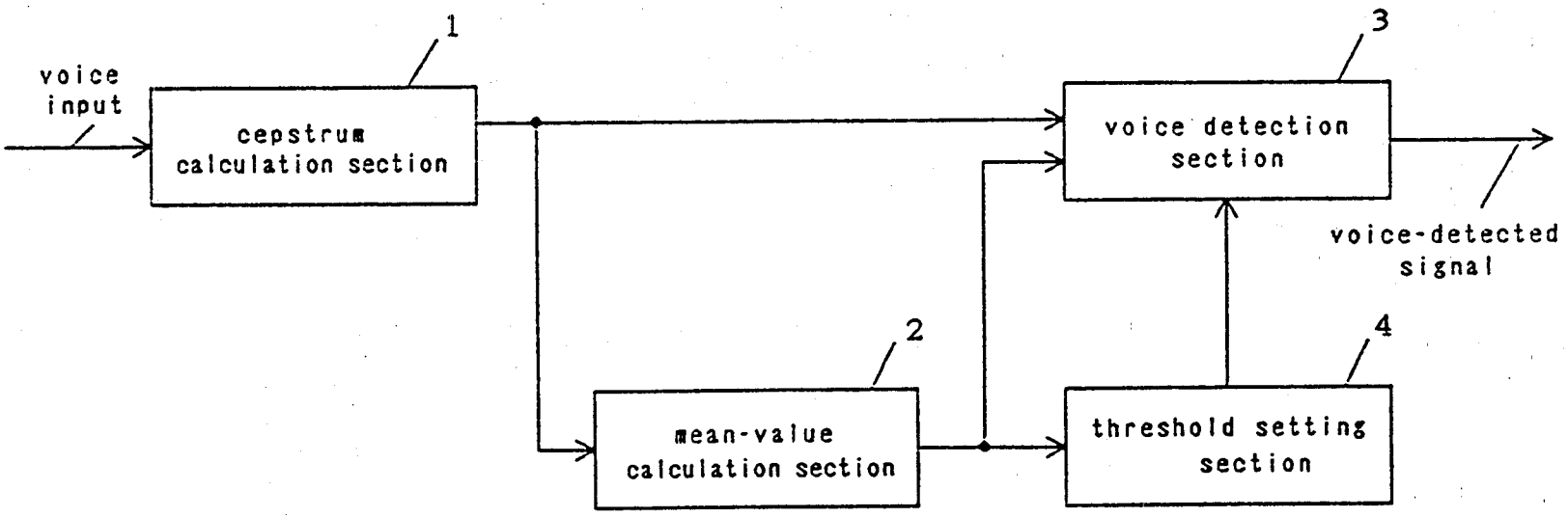
FIG. 2 is a block diagram of a voice detection device in an embodiment of the present invention.

FIG. 2 shows a block diagram of a voice detection device in an embodiment of the present invention. With reference to FIG. 2, the configuration and operation of the device will be explained. A voice signal is inputted into a cepstrum calculation section 1 as cepstrum calculation means which in turn obtains a cepstrum of the signal. Then, part of the cepstrum is supplied to a mean-value calculation section 2 as mean-value calculation means which in turn obtains a cepstrum mean-value. A voice detection section 3 as voice detection means is supplied with the cepstrum from the cepstrum calculation section 1 and the cepstrum mean-value from the mean-value calculation section 2. Then, the voice detection section 3 detects a peak of a cepstrum being equal to or more than the cepstrum mean-value, detects the presence/absence of a voice by the peak value, and when a cepstrum exceeding the cepstrum mean-value is larger than a threshold set value, generates a voice-detected signal. At that time, a threshold setting section 4 as threshold setting means generates a peak-value control signal having a value calculated according to a specified equation on the basis of the cepstrum mean-value from the mean-value calculation section 2, and specifies the minimum level of the voice detection in the voice detection section 3 according to the cepstrum mean-value.

According to the present embodiment as described above, the device can detect accurately the peak of a cepstrum even when subjected to a noise, thereby allowing a voice detection to be performed with a high accuracy.

That is, the present invention has a configuration comprising a cepstrum calculation section for calculating a cepstrum value from a voice signal, a mean-value calculation section for calculating a mean-value of the cepstrum at a set-quefrency interval, a voice detection section for determining the peak of the cepstrum and comparing the determined value with a reference value to discriminate the presence/absence of a voice, and a threshold setting section for setting the reference value of the voice detection section utilizing the mean-value of the cepstrum, with an effect that the cepstrum peak can be accurately detected even under an environment having noise, thereby allowing a voice detection to be performed with a high accuracy.

Referring to drawings, another embodiment of the present invention will be explained hereinafter.

Figure 3:
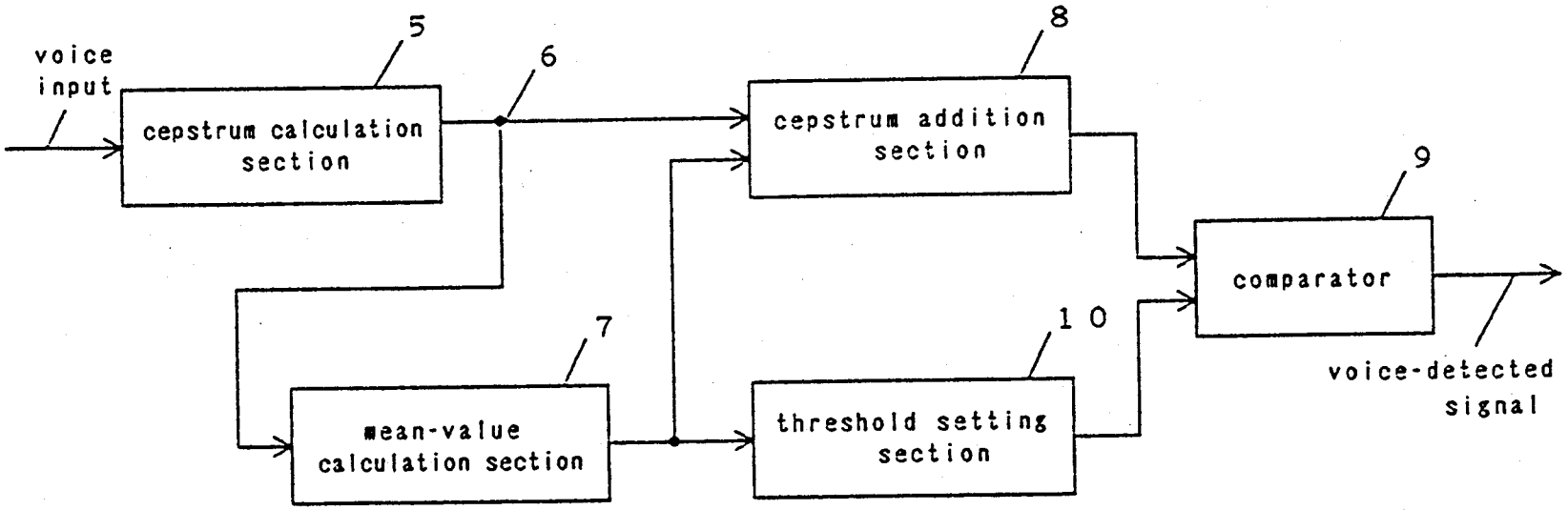
FIG. 3 is a block diagram of a voice detection device in another embodiment of the present invention.

FIG. 3 shows a block digram of a voice detection device in the embodiment of the present invention.

Figure 4:
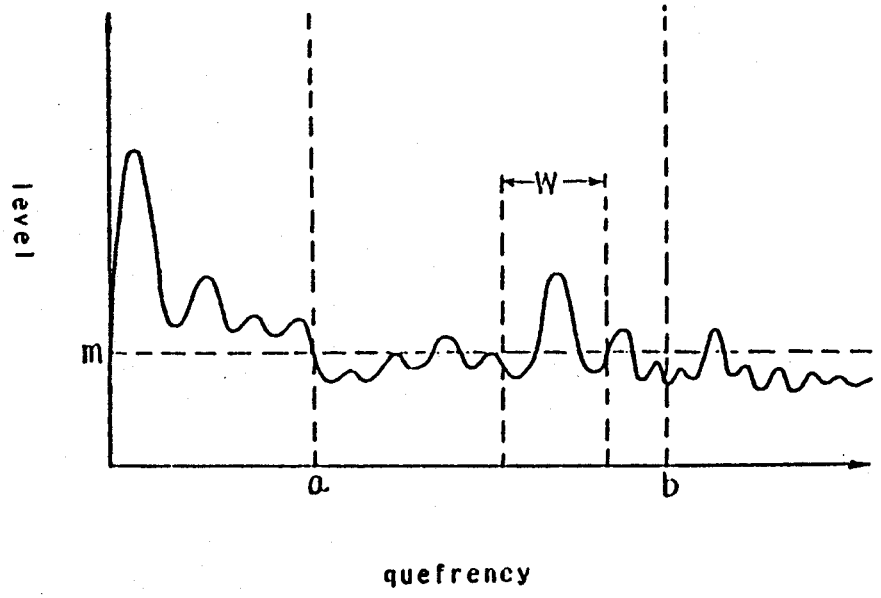
FIG. 4 is a cepstrum characteristic graph.

FIG. 4 shows a cepstrum of the cepstrum calculation section 1 in FIG. 3, which is expressed with an envelope, though actually a discrete value. The configuration and operation of the voice detection device of the present embodiment shown in FIG. 3 together with FIG. 4 will be explained. First, a voice signal is inputted into a cepstrum calculation section 5 which in turn obtains a cepstrum. Then, part of the cepstrum is supplied to a mean-value calculation section 7 which in turn obtains a cepstrum mean-value level m at the quefrency interval a-b shown in FIG. 4. A cepstrum addition section 8 is supplied with the cepstrum from the cepstrum calculation section 5 and the cepstrum mean-value from the mean-value calculation section 7. Then, the cepstrum addition section 8 adds a cepstrum value being equal to or more than the cepstrum mean-value level m at a quefrency width w within the scope of the quefrency interval a-b, and supplies the cepstrum-added result to a comparator 9. The comparator 9 is supplied with the cepstrum-added result from the cepstrum addition section 8 and a set output from a threshold setting section 10, and when the cepstrum-added result is larger than the threshold set value, outputs a voice-detected signal. At that time, the threshold setting section 10 calculates a threshold according to a specified equation on the basis of the cepstrum mean-value level m shown in FIG. 4, and supplies the threshold set value to be compared with the cepstrum-added result to the comparator 9.

According to the present invention as described above, the cepstrum peak can be accurately detected and the dependence on the cepstrum shape near the cepstrum peak becomes less, so that the ability of the cepstrum peak detection becomes large, thereby allowing a voice detection to be performed with a high accuracy. Also, setting a threshold according to the cepstrum mean-value allows a voice detection to be performed without depending to the magnitude of an input signal.

That is, the voice detection section is allowed to have a configuration comprising a cepstrum addition section for adding cepstrum when larger than the cepstrum mean-value, and a comparator for comparing the set value from the threshold setting section with the added result from the cepstrum addition section to perform a voice detection, with an effect that the dependence of the peak detection on the shape of the cepstrum peak becomes less, thereby allowing a voice detection to be performed with a high accuracy. An effect is further obtained that the determining of a threshold set value according to the cepstrum mean-value allows a voice detection to be performed without depending on the magnitude of an input signal.

Referring to drawings, another embodiment of the present invention will be explained hereinafter.

Figure 5:
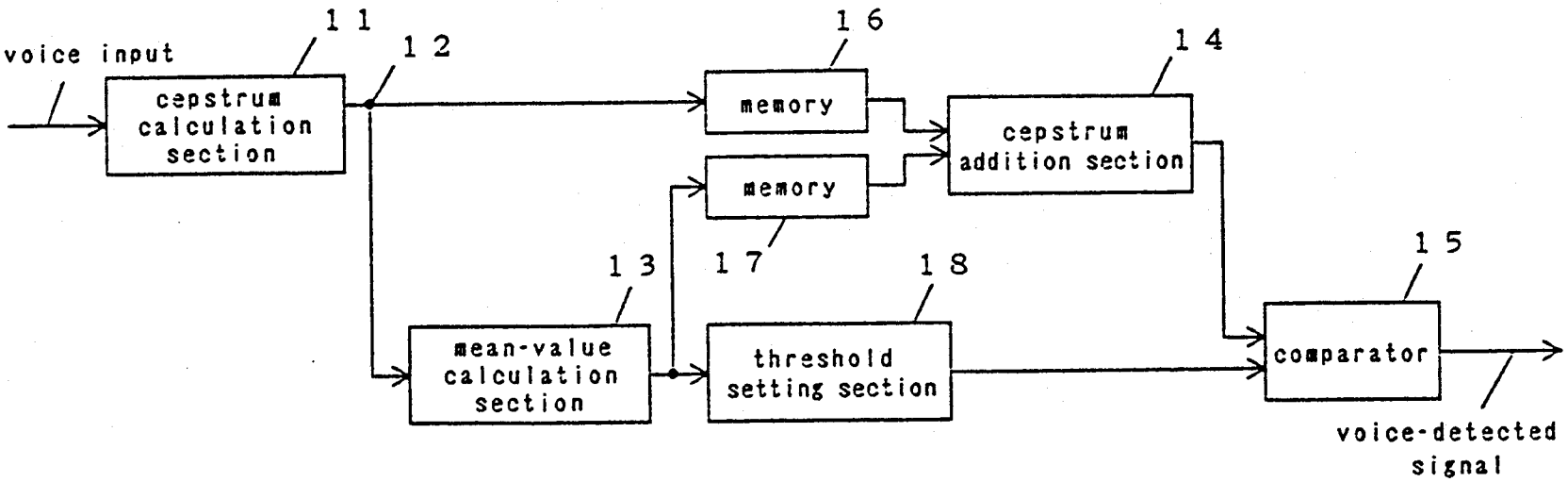
FIG. 5 is a block diagram of a voice detection device in another embodiment of the present invention.
Figure 6:
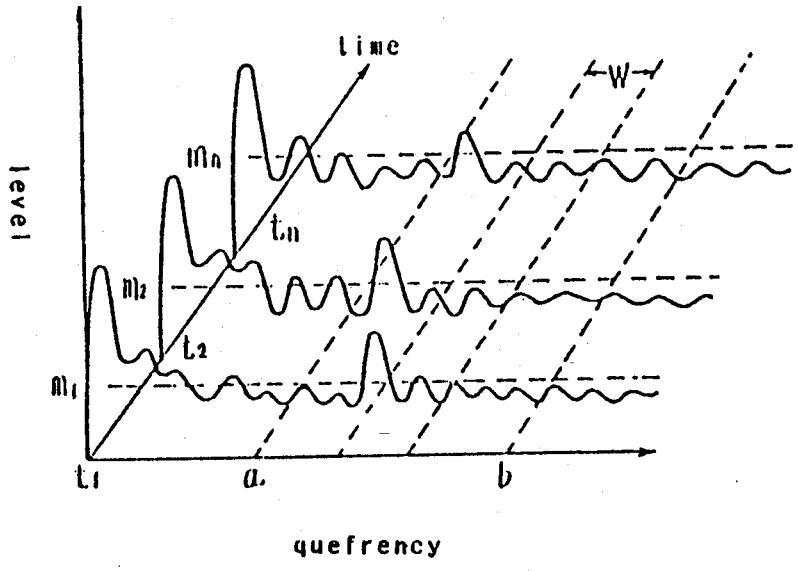
FIG. 6 is a time-dependent cepstrum characteristic graph.

FIG. 5 shows a block diagram of a voice detection device in an embodiment of the present invention, and FIG. 6 shows a cepstrum output of a cepstrum calculation section 11. In FIG. 6, the a-b indicates a quefrency interval, the $m_1$ and $m_n$ are cepstrum mean-values at the interval a-b at the time of $t_1$ and $t_n$, and the w is a peak detection width. Using FIG. 6, the configuration and operation of the embodiment shown in FIG. 5 will be explained. First, a voice signal is inputted into the cepstrum calculation section 11 which in turn obtains a cepstrum output. The, part of the cepstrum output is supplied to a mean-value calculations section 13 which in turn obtains a cepstrum mean-value at the quefrency interval a-b shown in FIG. 6. A memory group 17 having a plurality of n storage places is supplied with the cepstrum mean-value from the mean-value calculation section 13, stores the values from the cepstrum mean-value $m_1$ at the time $t_1$ to the cepstrum mean-value $m_n$ at the time $t_n$ shown in FIG. 6, and supplies the stored values to a cepstrum addition section 14. A memory group 16 having n-set storage places is supplied with the cepstrum output from the cepstrum calculation section 11, stores the cepstrum from the value at the time $t_1$ to the value at the time $t_n$, and supplies the stored values to the cepstrum addition section 14. The cepstrum addition section 14 is supplied with the cepstrum from the memory 16 and the cepstrum mean-value from the memory 17, adds cepstrum values larger than the cepstrum mean-value at each time from the time $t_l$ to the time $t_n$ and at the width w of the quefrency interval a-b shown in FIG. 6, and supplies the cepstrum-added result to a comparator 15. The comparator 15 is supplied with the cepstrum-added result from the cepstrum addition section 14 and a threshold-set value calculated by a threshold setting section 18, and when the cepstrum-added result is larger than the threshold-set value, outputs a voice-detected signal. At that time, according to the cepstrum mean-value at the time from $t_l$ to $t_n$ shown if FIG. 6, the threshold setting section 18 supplies the threshold-set value to be compared with the cepstrum-added result to the comparator 15. The memory groups 16 and 17 are in a condition that, when a new input is inputted into the memory groups, old data is shifted to the next storage place so that a plurality of data can always be referred in parallel. According to the present embodiment as described above, the referring of the time-dependent changes of the cepstrum peak allows a more accurate voice detection to be performed.

As apparent by the above explanation, the present invention has a configuration comprising a cepstrum calculation section for calculating a cepstrum value from a voice signal, a mean-value calculation section for calculating a mean-value of the cepstrum at a set-quefrency interval, a voice detection section for determining the peak of the cepstrum and comparing the determined value with a reference value to discriminate the presence/absence of a voice, and a threshold setting section for setting the reference value of the voice detection section utilizing the mean-value of the cepstrum, with an effect that the cepstrum peak can be accurately detected even under an environment having noise, thereby allowing a voice detection to be performed with a high accuracy.

That is, the voice detection section is allowed to have a configuration comprising a first memory group consisting of n sets for storing cepstrum, a second memory group consisting of n sets for storing the cepstrum mean-value, a cepstrum addition section for adding cepstrums when larger than the cepstrum mean-value, and a comparator for comparing the set value from the threshold setting section with the added result from the cepstrum addition section to perform a voice detection, with an effect that the accumulating of data in time series on the memory groups allows the time-dependent changes of cepstrum to be detected and a more accurate voice detection to be performed.

Referring to drawings, another embodiment of the present invention will be explained hereinafter.

Figure 7:
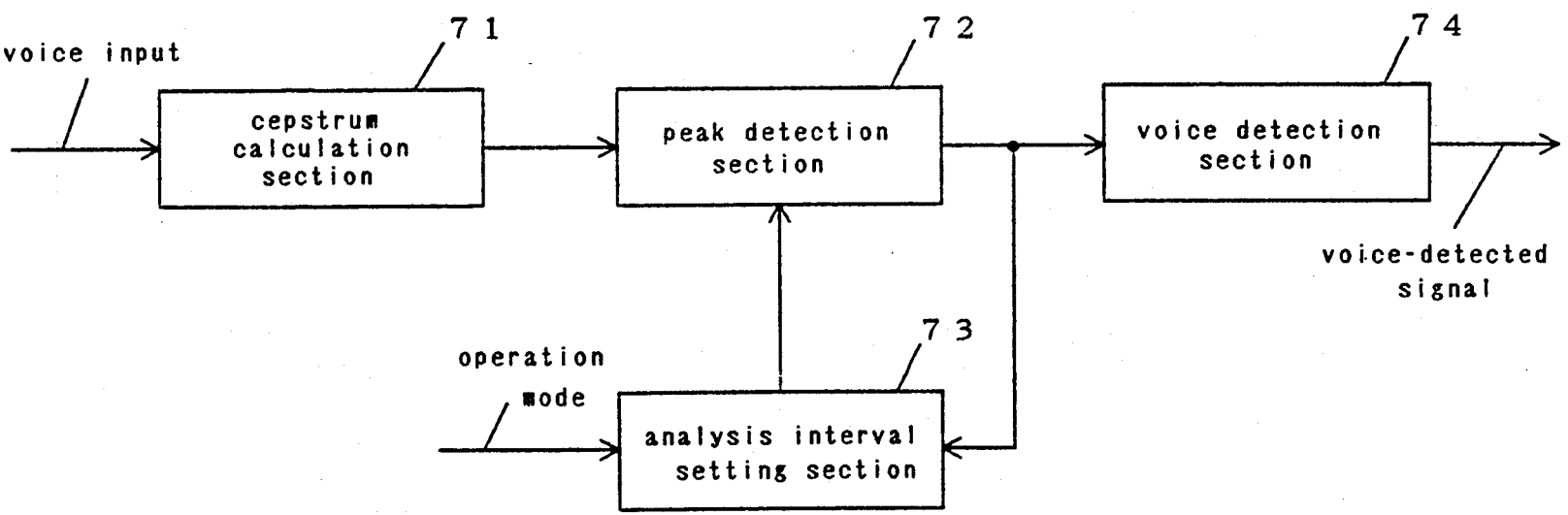
FIG. 7 is a block diagram of a voice detection device in another embodiment of the present invention.

FIG. 7 shows a block diagram of a voice detection device in an embodiment of another present invention.

According to the drawings, the configuration and operation of the device will be explained. First, a voice input is inputted into a cepstrum calculation section 71 as cepstrum calculation means which in turn obtains a cepstrum. The cepstrum is supplied to a peak detection section 72 as peak detection means which in turn obtains a cepstrum peak at an analysis interval directed by an analysis setting section 73. A voice detection section 74 as voice detection means compares the cepstrum peak with a predetermined threshold, and when detecting the input to be a voice, outputs a voice-detected signal. At that time, the analysis interval setting section 73 as analysis interval setting means directs an analysis interval to the peak detection section 72 and the analysis interval setting section 73 is controlled by an operation mode setting signal in a manner as described below. First, in a first operation mode, the analysis interval setting section 73 directs a predetermined quefrency analysis interval to the peak detection section 72, and sets a quefrency analysis interval which is directed to the peak detection section 72 in a second operation mode in response to the cepstrum peak obtained from the peak detection section 72. Then, in the second operation mode, the analysis interval setting section 73 directs the analysis interval having been set under the first operation mode to the peak detection section 72.

The shift from the first mode to the second mode may be performed either by an operation mode setting signal of the manual operation, or by the automatic generation of the operation mode setting signal after a specified time has lapsed or a specified number of voice detection signals have been outputted.

According to the present embodiment as described above, the analysis interval setting of a peak can be previously set, so that an analysis interval to determine the cepstrum peak may be narrowed down to improve processing speed. Also, the scope of the cepstrum peak to be detected is detected in the first operation mode, and narrowed down by speaker, thereby allowing an accurate voice detection for the same speaker to be detected. Further, it will be appreciated that, even when a voice is temporarily superimposed by another voice-noise, the scope of the cepstrum peak to be detected has been narrowed down, thereby allowing an accurate voice detection to be performed.

That is, apparent by the above explanation, the present invention comprises cepstrum calculation means for calculating a cepstrum of a voice input, peak detection means for detecting a peak of the cepstrum output of the cepstrum calculation means, analysis interval setting means for setting an analysis interval from the peak-detected output of the peak detection means and from an operation mode setting signal, and voice detection means to which the peak-detected output of the peak detection means is supplied, and a peak detection interval of the peak detection means is controlled by the set output of the analysis interval setting means, so that the analysis interval of the cepstrum peak can be previously set optimally, and narrowed down by shifting the mode, thereby allowing the speed of the processing for determining the cepstrum peak to be improved. Also, the narrowing down of the scope of the cepstrum peak detected according to a speaker allows an accurate voice detection to performed for the same speaker. Further, the cepstrum peak to be analyzed is narrowed down even when a voice is superimposed by a noise, thereby allowing a highly accurate voice detection to be performed and an excellent operability to be obtained.

Referring to drawings, an embodiment of another present invention will be explained hereinafter.

Figure 8:
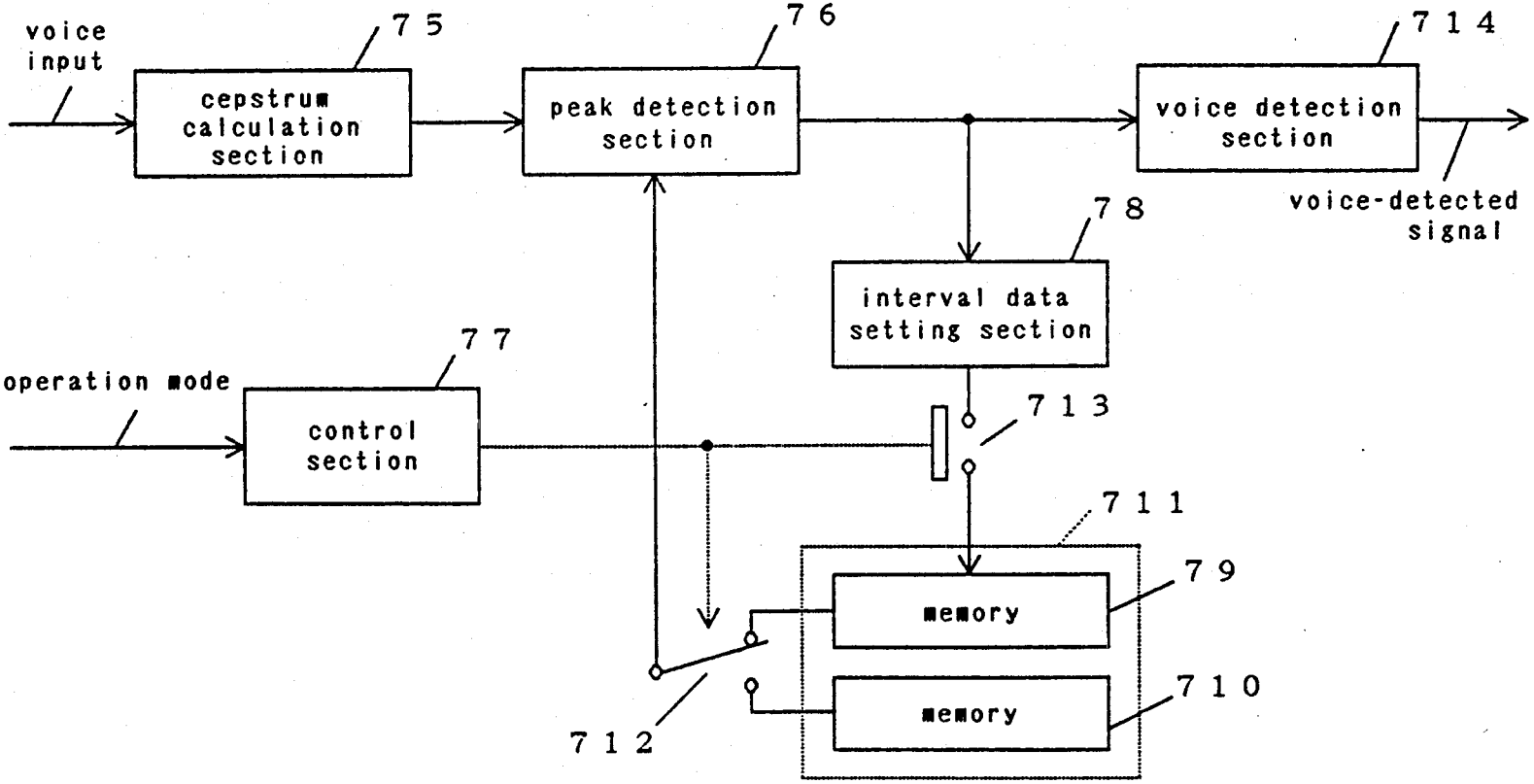
FIG. 8 is a block diagram of a voice detection device in another embodiment of the present invention.

FIG. 8 is a block diagram of a voice detection device in an embodiment of the present invention.

According to FIG. 8, the configuration and operation of the device will be explained. First, a cepstrum calculation section 75 obtains a cepstrum from a voice input, and supplies the cepstrum to a peak detection section 76. The peak detection section 76 detects the cepstrum peak from the cepstrum supplied, and is controlled such that the peak detection width of the cepstrum supplied from the cepstrum calculation section 75 is controlled using quefrency interval data obtained through a second switch 712 from an interval data memory section 711. A voice detection section 714 performs a voice detection from the cepstrum peak obtained by the peak detection section 76 on the basis of a predetermined threshold, and when detecting the input to be a voice, outputs a voice-detected signal. At that time, an interval data setting section 78 sets a quefrency interval to be detected on the basis of the cepstrum peak obtained by the peak detection section 76. The interval data set by the interval data setting section 78 is written into a first memory group 79 by turning-on of a first switch 713 by a control signal from a control section 77 in response to an operation mode. The control section 77, as described above, controls the first switch 713, and also controls the second switch 712 in response to an operation mode. The second switch 712 is controlled such that the switch is connected to the first memory group 79 when the first switch 713 is off, and is connected to a second memory group 710 when the first switch 713 is on. The interval data of the first memory group 79 and the second memory group 710 of the interval data memory section 111 are supplied through the second switch 712 to the peak detection section 76 as the analysis interval data thereof in response to an operation mode. Interval data has been previously set in the second memory group 710.

Using FIG. 9, the interval data supplied to the peak detection section 76 will be explained in detail hereinafter.

Figure 9:
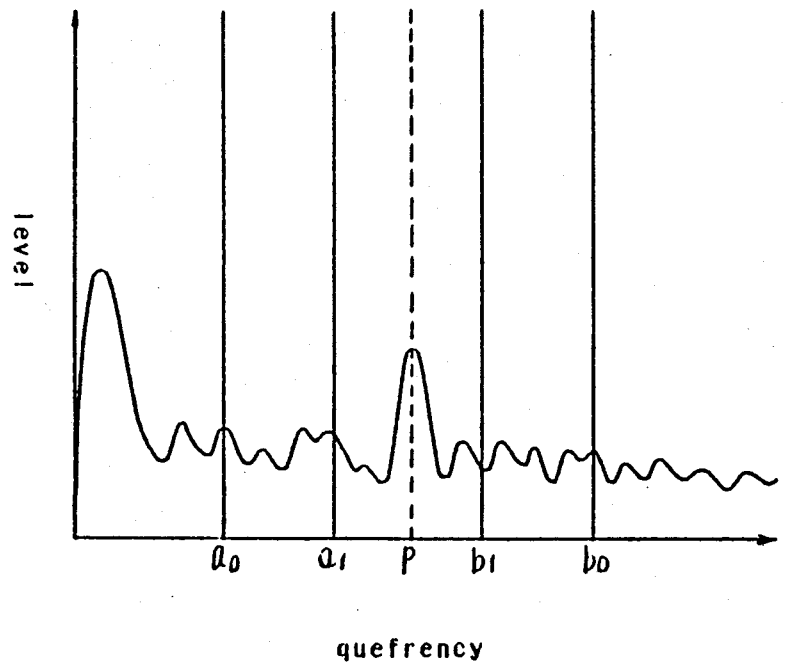
FIG. 9 is a cepstrum characteristic graph.

A cepstrum obtained by the cepstrum calculation section 75 is shown in FIG. 9, and indicated with an envelope, though actually a discrete value. The reference symbol p indicates a quefrency of the cepstrum peak, the $a_0$-$b_0$ does an analysis interval previously stored in the second memory group 710, and the $a_1$-$b_1$ does an analysis interval stored in the first memory group 79. For a voice input, the cepstrum peak occurs at the position of the quefrency p as shown in FIG. 9.

First, consider a case where, in the first mode, the second switch 712 is connected to the second memory group 710, and the first switch 713 connected to the first memory group 79. In that case, when a voice input is present, since the second switch 712 is connected to the second memory group 710, the peak detection section 76 determines the cepstrum peak in the interval data $a_0$-$b_0$ of the second memory contents, and obtains the quefrency p of the cepstrum peak. The interval data setting section 78, using the quefrency p being the cepstrum peak obtained by the peak detection section 76, selects a value near the quefrency p to determine the interval data $a_1$-$b_1$, and stores the interval data $a_1$-$b_1$ through the first switch 713 in the first memory group 79. Then, consider a case where, in the second mode, the second switch 712 is connected to first memory group 79, and the first switch 713 is off. In that case, since the second switch 712 is connected to the first memory group 79, the peak detection section 76 detects the cepstrum peak in the interval data $a_1$-$b_1$ of the first memory described in FIG. 7.

According to the present embodiment as described above, a cepstrum peak analysis interval has been previously set to be stored in the memory, so that an optimum cepstrum peak analysis interval can always be supplied, and reset to a more narrow analysis interval according to the detected result, thereby allowing processing time to be shortened, and a voice detection to be performed with high accuracy with respect to noise prevention. It will also be appreciated that, once an analysis interval has been set, the analysis interval is always valid, thereby allowing an effective voice detection processing, to be performed with an excellent operability.

The memory groups are not limited to two sets, and there is no trouble even if an additional set is added as required to the groups of which a set is selectively used.

That is, in place of the analysis interval setting means of the previous present invention, the present invention includes the interval data setting means, a plurality of memory groups, the first switch for connecting interval data to the first memory, the second switch for selecting the interval data of the memory groups and supplying the data to the peak detection section, and the control section for controlling the first and second switches in response to the operation mode, so that the cepstrum analysis interval is narrowed down in response to a predetermined analysis interval and the input in similar manner to that of the previous present invention to obtain a similar effect to the previous present invention, and an increase in the number of the memory groups allows the analysis interval to be set in various ways.

Figure 10:
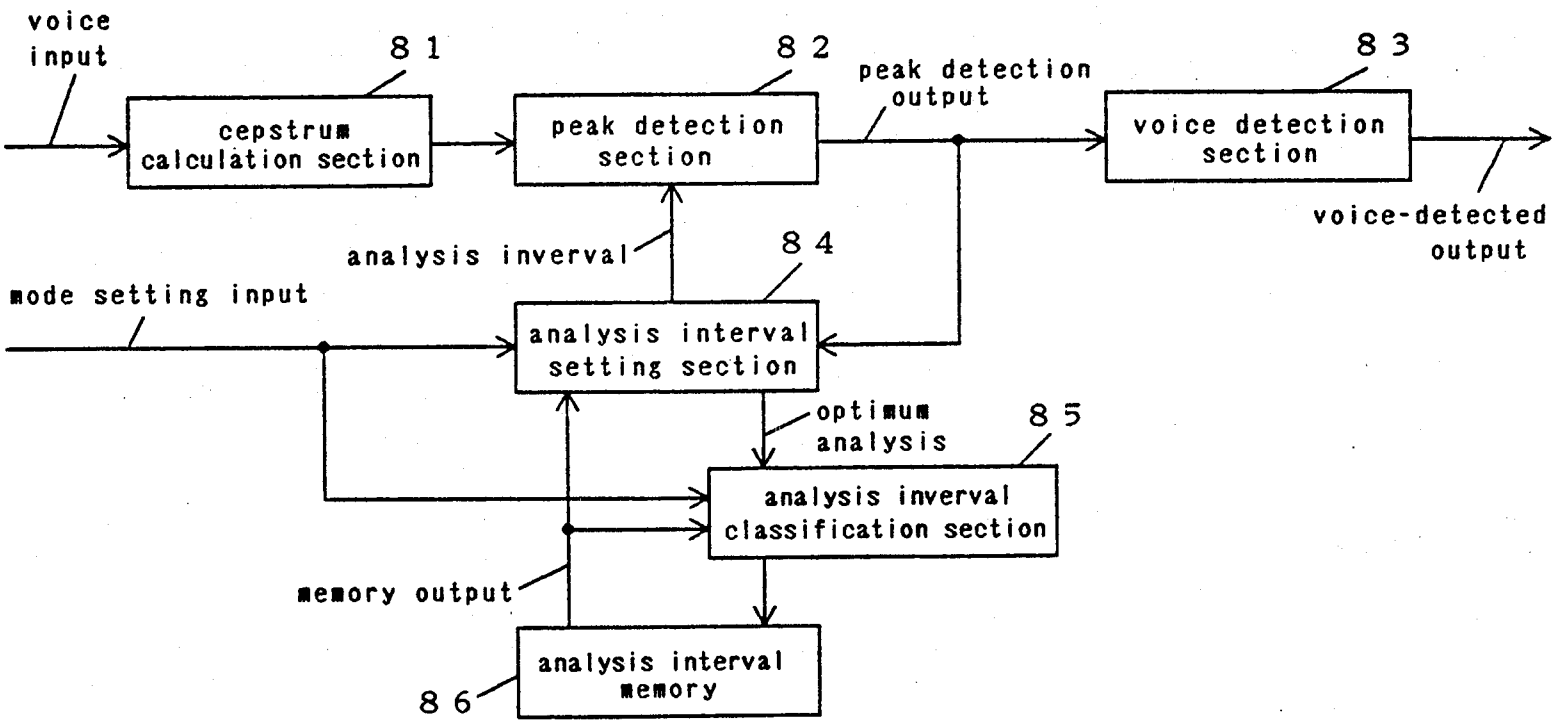
FIG. 10 is a block diagram of another embodiment of the present invention.

FIG. 10 shows a block diagram of a voice processing device of another embodiment according to the present invention. As shown in FIG. 10, a cepstrum calculation section 81 calculates a cepstrum of a voice input, and supplies the calculated cepstrum to a peak detection section 82, and the peak detection section 82 detects a peak of the cepstrum at the analysis interval inputted from an analysis interval setting section 84, and supplies the peak to a voice detection section 83 and the voice interval setting section 84. The voice detection section 83 detects the presence/absence of a voice from the cepstrum peak supplied from the peak detection section 82 to obtain a voice-detected output. The voice interval setting section 84 calculates an optimum analysis interval in response to the cepstrum peak supplied from the peak detection section 82 and supplies the calculated interval to an analysis interval classification section 85, and further supplies analysis interval data supplied from an analysis interval memory 86 by the direction of the analysis interval classification section 85 in response to a mode setting input, or a predetermined analysis interval data to the peak detection section 82. The analysis interval classification section 85 compares the optimum analysis interval data with analysis interval data stored in the analysis interval memory 86 to perform classification processing, and stores the data in the analysis interval memory 86 in response to the mode setting input or reads the data from the analysis interval memory 86 to control the analysis interval.

The operation of the device with the above configuration will be explained.

Figure 11:
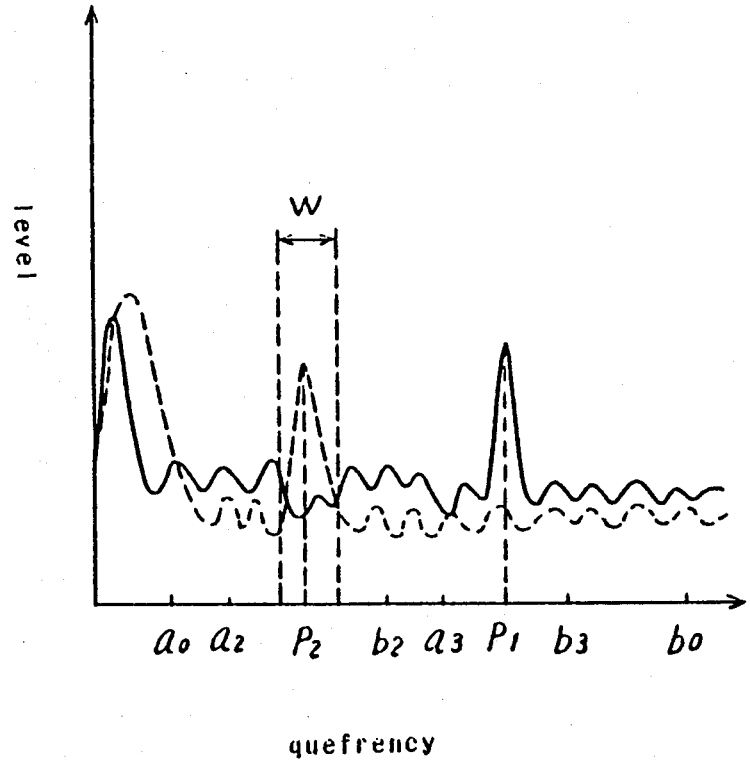
FIG. 11 is a cepstrum characteristic graph illustrating the operation of an embodiment of the present invention.

A voice input is calculated for a cepstrum thereof by the cepstrum calculation section 81, then detected for a peak of the cepstrum by the peak detection section 82, then detected for the presence/absence of a voice by the voice detection section 83, and outputted as a voice-detected signal. At that time, the peak detection section 82 operates in such a manner that the section 82 specifies a quefrency to determine the cepstrum peak in accordance with the analysis interval supplied from the voice interval setting section 84 to perform peak detection. Referring to FIG. 11, the operation of the analysis interval setting section 84, the analysis interval classification section 85 and the analysis interval memory 86 will be explained hereinafter. The cepstrum determined by the cepstrum calculation section 81 is shown in FIG. 11, wherein the axis of ordinate represents the level of a cepstrum and the axis of abscissa does a cepstrum. The reference symbols $p_1$ and $p_2$ indicate quefrency values determined by the peak detection section 82, and the intervals $a_0$-$b_0$, $a_2$-$b_2$, and $a_3$-$b_3$ indicate the analysis intervals, outputted from the analysis interval setting section 84, the analysis interval memory 86 and the analysis interval classification section 85, respectively. First, when the mode setting input is "REGISTRATION", the analysis interval setting section 84 supplies the widest analysis interval $a_0$-$b_0$ for the peak detection to the peak detection section 82, and a cepstrum having a peak in the quefrency $p_1$ indicated with solid line in FIG. 11 in response to the voice input, is obtained from the peak detection section 82. The analysis interval setting section 84 calculates the optimum analysis interval $a_3$-$b_3$ narrower than the analysis interval $a_0$-$b_0$ with respect to the quefrency $p_1$, and supplies the calculated interval to the analysis interval classification section 85. The analysis interval classification section 85 compares the optimum analysis interval with the analysis interval of the analysis interval memory 86, and when an analysis interval containing the optimum analysis interval with a proportion equal to or more than a predetermined value (which is defined as a similar analysis interval) is not present, stores the optimum analysis interval $a_3$-$b_3$ in the analysis interval memory 86, while when the similar analysis interval is present, replaces the similar analysis interval with a composed analysis interval described below, and stores the composed interval. The composed analysis interval is an analysis interval which contains a superimposed interval of the optimum analysis interval and the memory analysis interval, and whose lower and upper limits are contained in either of the above-described intervals.

Then, when the mode setting becomes "RECOGNITION" with the analysis interval $a_3$-$b_3$ stored in the memory, the analysis interval setting section 84 supplies the predetermined interval $a_0$-$b_0$ or a memory analysis interval wider than the $a_0$-$b_0$ to the peak detection section 82.

Now assuming that a cepstrum having a peak in the quefrency $p_1$ in response to the voice input as indicated with broken line in FIG. 11 is obtained from the peak detection section 82, the analysis interval setting section 84 calculates the analysis interval $a_3$-$b_3$ in response to the $p_1$, the analysis interval classification section 85 checks the presence of the analysis interval similar to the analysis interval $a_3$-$b_3$ on the analysis interval memory 86, and since the interval is present in that case, the peak detection section 82 is supplied with the analysis interval $a_3$-$b_3$ from the memory 86. At that time, since the analysis interval is limited to a value near the peak, the peak detection by the peak detection section 82 can be processed with a high speed. When a voice input having a peak in the quefrency $p_2$ is present, the analysis interval setting section 84 calculates the optimum analysis interval $a_2$-$b_2$, the analysis interval classification section 85 checks an interval similar to the optimum analysis interval, and since the interval is not present in that case, the analysis interval supplied to the peak detection section 82 remains the $a_0$-$b_0$.

According to a voice processing device of the embodiments of the present invention as described above, the analysis interval with a voice by a plurality of speakers is classified into group or individual when "REGISTERED", whereby the analysis interval for the peak detection can be defined and set when recognized. Accordingly, the voice detection can be processed with a high speed, and the analysis interval is classified and defined, whereby an effective operation can be performed with respect to noise prevention when the cepstrum peak is detected, and an accurate voice detection be performed.

As apparent by the above embodiments, a signal processing device of the present invention has a configuration comprising an analysis interval setting section for calculating an optimum analysis interval in response to the peak output of a peak detection section and supplying the analysis interval in response to a mode setting input to the peak detection section, and an analysis interval classification section for classifying the optimum analysis interval calculated by the analysis interval setting section and the analysis interval stored in an analysis interval memory for string; and has an effect that, since the voice of a plurality of speakers not limiting to individual is classified, and the analysis interval of the cepstrum peak is set by group or individual when registered, whereby the analysis interval of the cepstrum peak when recognized can be defined to perform a high-speed processing. Also, the device has another excellent effect that the analysis interval is classified into groups or individuals, whereby, even if a noise is present when the cepstrum peak is detected, an extremely good voice detection operation is performed, allowing an accurate voice detection to be performed.

Figure 12:
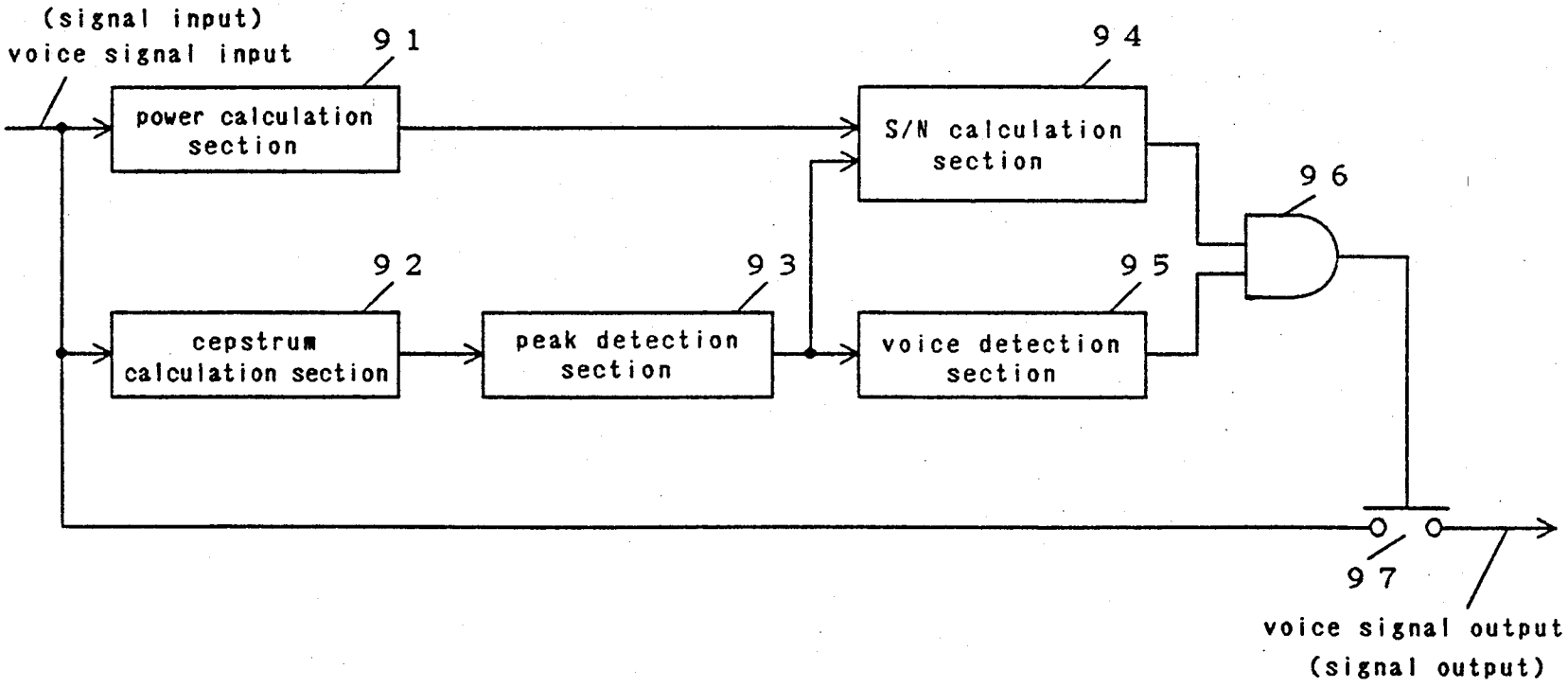
FIG. 12 is a block diagram of another embodiment of the present invention.

Referring to FIG. 12, another embodiment of the present invention will be explained hereinafter.

As shown in FIG. 12, a power calculation section 91 is supplied with a voice input, calculates the power thereof, and supplies the calculated power to an S/N calculation section 94. A cepstrum calculation section 92 is also supplied with the voice input, calculates a cepstrum, and supplies the cepstrum to a peak detection section 93. The peak detection section 93 detects a peak of the cepstrum, and supplies the peak to the S/N calculation section 94 and a voice detection section 95. The voice detection section 95 detects the presence/absence of a voice from the cepstrum peak of the peak detection section 93, and supplies the result to an AND section 96. The S/N calculation section 94 is supplied with the power from the power calculation section 91 and the cepstrum peak from the peak detection section 93, calculates an S/N from the supplied data, and supplies the superiority/inferiority of the calculated result to a specified value to the AND section 96. The AND section 96 is configured in a manner to take a logical product of the signals supplied from the voice detection section 95 and the S/N calculation section 94 so as to control a switch 97.

The operation of the device with the above configuration will be explained.

A voice signal input is calculated for the power thereof by the power calculation section 91, and detected for a peak of the cepstrum thereof through the cepstrum calculation section 92 and the peak detection section 93. The voice detection section 95, using the cepstrum peak, detects the presence/absence of a voice signal, and supplies a signal indicating the presence/absence of a voice signal to the AND section 96. Using the voice signal input power obtained from the power calculation section 91 and the cepstrum peak obtained from the peak detection section 93, the S/N calculation section 94 calculates an S/N of the voice signal input, detects whether the S/N is equal to or more than a specified value, or less than the specified value, and supplies the detected signal to the AND section 96. The AND section 96 operates such that the section 96, only when obtaining a signal indicating that the S/N of the voice signal input is equal to or more than the specified value from the S/N calculation section 94, and obtaining a signal indicating that a voice is present in the voice signal input from the voice detection 95, supplies a signal for turning the switch 97 on to the switch 7, and allows the voice signal input to pass so as to obtain a voice signal output.

According to the signal control device of the embodiment of the present invention as described above, an effect is obtained that a voice signal output is outputted only when a voice is present in the voice signal input, and the S/N thereof is good, so that, if the noise power of the voice signal input is large, the voice signal output is not outputted. There is also another effect that the voice signal output obtained has a good S/N, whereby, when the voice signal output is inputted into a voice recognition device and the like, a good result can be obtained. And then the present invention can be applied to signal other than voice signal.

That is, by the above embodiment, the present invention includes an S/N calculation section for calculating an S/N with a power of a signal input and a cepstrum peak, and a signal detection section for detecting a signal from the cepstrum peak of the signal input, and has a configuration in which an AND section for taking a logical product of the S/N output from the S/N calculation section and the detected output from the signal detection section, outputs a signal to control a switch, and controls the passing of the signal input to obtain a signal output, whereby, only when a signal is present in the input, and the S/N thereof is good, the signal output can be outputted.

Accordingly, an effect is obtained that, if the noise power of a signal input is large, a signal output is not outputted. There is also an effect that, since the S/N of the signal output obtained is good, a good result can be obtained when the signal output is inputted into a voice recognition device and the like.

Figure 13:
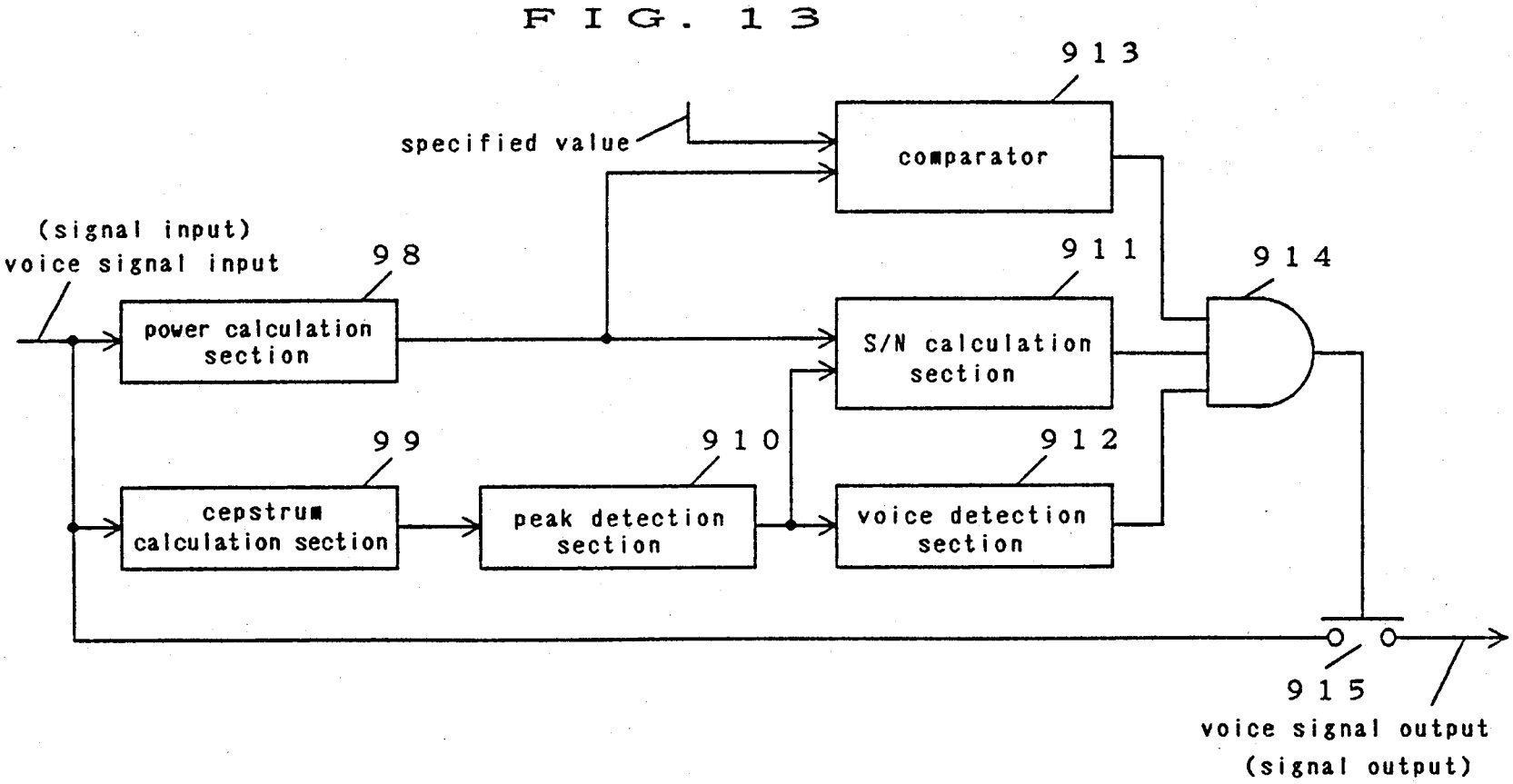
FIG. 13 is a block diagram of another embodiment of the present invention.

Referring to FIG. 13, a signal control device of another embodiment of the present invention will be explained hereinafter. The embodiment is similar to that in FIG. 12.

In FIG. 13, the device is configured such that a comparator 913 compares a power from a power calculation section 98 with a reference signal input, and supplies the compared result to an AND section 114. The AND section 114 takes a logical product of signals supplied from a voice detection section 912, an S/N calculation section 911 and the comparator 913 to control a switch 915.

The operation of the device having the above configuration will be explained.

The power calculation section 98 calculates a power of a voice signal input, and then the comparator 913 detects whether the power is equal to or more than a specified value, or less than the specified value, and supplies the detected signal to the AND section 114. A cepstrum calculation section 99 through a peak detection section 910 detects a peak of the cepstrum of the voice signal input. Using the cepstrum peak, the voice detection section 912 detects the presence/absence of a voice signal, and supplies a signal indicating the presence/absence of a voice signal to the AND section 114. Using the voice signal input power obtained from the power calculation section 98 and the cepstrum peak obtained from the peak detection section 910, the S/N calculation section 911 calculates an S/N is equal to or more than a specified value, or less than the specified value, and supplies the detected signal to the AND section 114. The AND section 114 operates such that, only when that section obtains a signal indicating that the voice signal input power is equal to or more than a specified value from the comparator 913, a signal indicating that the voice signal input S/N is equal to or more than a specified value from the S/N calculation section 911, and further a signal indicating that a voice is present in the voice signal input from the voice detection section 912, that section supplies a signal for turning on the switch 915 to the switch 915, allows the voice signal input to pass, and obtains a voice signal output. According to the embodiment of the present invention as described above, the voice signal output can be outputted only when a voice is present in the voice signal input, the S/N is good, and the power is sufficiently present. Accordingly, the device has an effect that a voice having a sufficient power and a good S/N as a voice signal output is obtained. Also, since the power is also detected, the input status of a voice can be detected, and for example, using the signal control device of the embodiment for voice recognition allows a signal having a good speaking status, in particular, a good pronunciation level of a speaker to be selected, thereby causing a better result to be obtained.

That is, the device is configured in a manner to include a comparator for comparing a signal input power with a specified value and to control the switch by taking the logical product of the S/N output from the S/N calculation section, whereby, only when a signal is present in the signal input, the S/N is good, and the power is sufficiently present, a signal output can be supplied. Accordingly, the device has an effect that a signal having a sufficient power and a good S/N as a signal output is obtained. Also, since the power is also detected, the input status of a voice can be detected, and a signal having a good speaking status, in particular, a good pronunciation level of a speaker can be selected, thereby providing an effect that, when the signal control device of the present invention is used for a voice recognition device and the like, a good result is obtained.

Figure 14:
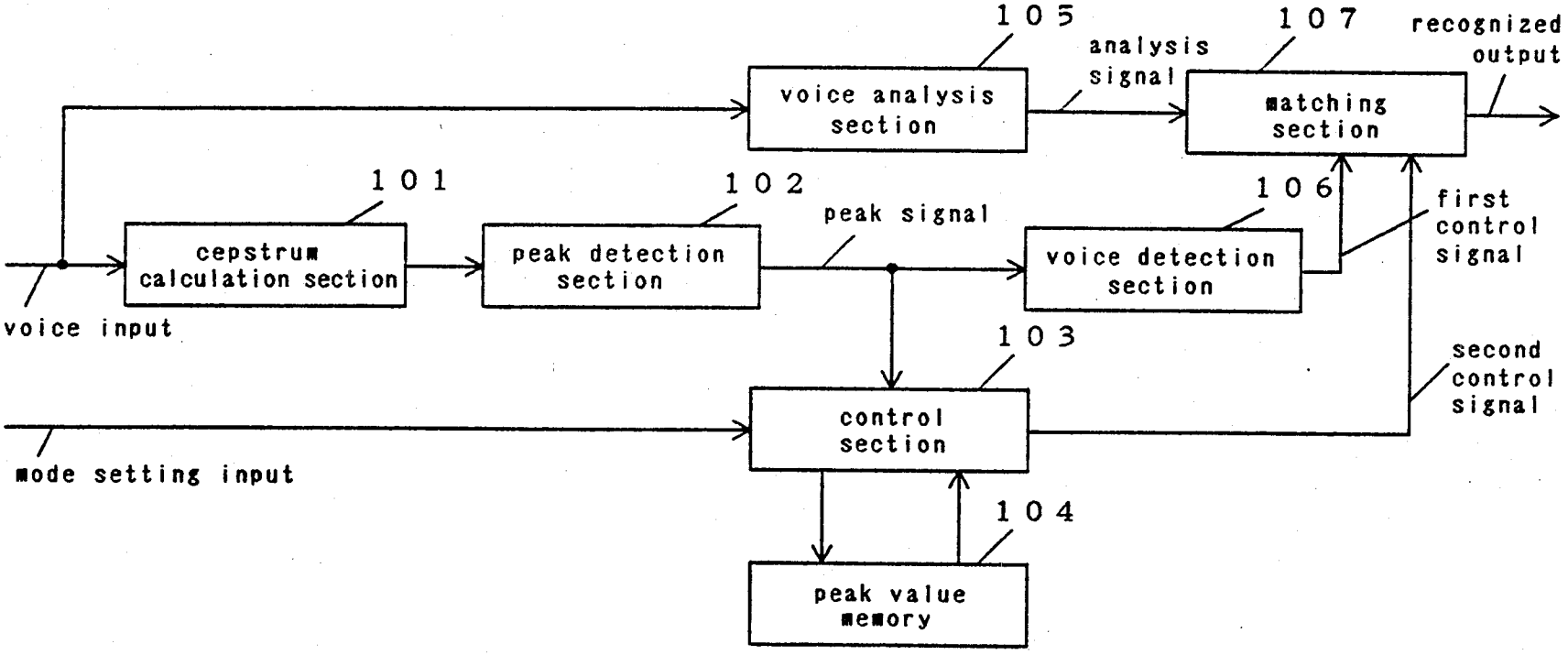
FIG. 14 is a block diagram of another embodiment of the present invention.

Referring to FIG. 14, another embodiment of the present invention will be explained hereinafter.

FIG. 14 is a block diagram of a signal processing device in an embodiment of another present invention. Using FIG. 14, the configuration of the device will be explained below. A cepstrum calculation section 101 calculates a cepstrum from a voice input, and supplies the cepstrum to a peak detection section 102. The peak detection section 102 detects a peak from the cepstrum, and supplies the peak to a control section 103 and a voice detection section 106. The voice detection section 106 detects the presence/absence of a voice by the presence/absence of the cepstrum peak signal supplied from the peak detection section 102, and supplies a first control signal to a matching section 107. The control section 103 supplies the cepstrum peak signal supplied from the peak detection section 102 to a peak-value memory 104 according to a mode setting input, and using data supplied from the peak-value memory 104, outputs a second control signal to the matching section 107. The peak-value memory 104, which stores the cepstrum peak signal from the peak detection section 102, stores and reads data through the control section 103. A voice analysis section 105 analyzes the signal input for a data format used in the matching section 107, and supplies the analyzed signal to the matching section 107. The matching section 107 is supplied with the analyzed signal from the voice analysis section 105, and the first and second control signals from the voice detection section 106 and the control section 103, and, in response to the control signals, checks the analyzed signal supplied from the voice analysis section 105 against a template to obtain a recognized output.

The operation of the device having the above configuration will be explained. First, when the mode setting input is "REGISTRATION", the cepstrum calculation section 101 calculates a cepstrum from a voice input, then the peak detection section 102 detects a peak of the cepstrum, supplies the peak to the control section 103, and then stores the peak through control section 103 in the peak-value memory 104. Then, the control section 103 supplies the second control signal for performing no matching processing to the matching section 107. Then, when the mode setting input is "RECOGNITION", similarly the cepstrum calculation section 101 calculates a cepstrum from a voice inout, and then the peak detection section 102 detects a peak of the cepstrum. Then, the voice detection section 106 detects the presence/absence of a voice by the presence/absence of a voice by the presence/absence of the cepstrum peak signal from the peak detection section 102, and when a voice is present, supplies the first control signal for performing matching processing to the matching section 107, while when a voice is not present, supplies the first signal for performing no matching processing to the matching section 107. At the same time, the control section 103 compares the cepstrum peak signal from the peak detection section 102 with the contents previously stored in the peak-value memory 104, and when the quefrency values of the both are close to each other, supplies the second signal for performing matching processing to the matching section 107, while when the quefrency values of the both are not close to each other, supplies the second signal for performing no matching processing to the matching section 107. Then, the matching section 107, when the both first and second signals supplied from the voice detection section 106 and the control section 103 are those for performing matching processing, compares the analyzed signal from the voice analysis section 105 with the data of the template to perform a recognition processing operation, and outputs the result as a recognized output.

According to the signal processing device in the embodiment of the present invention as described above, only when the quefrency of the cepstrum peak of a voice input, that is, the pitch frequency of a speaker is close to a previously registered frequency, the matching processing with the template is performed, so that, when a voice input other than a registered speaker is inputted, the matching processing is not performed, thereby allowing the processing time required for the matching processing of the matching section to be eliminated, that is, when a voice input other than a registered speaker is inputted, a reject result is immediately outputted.

Further, where the device is configured by a microprocessor and the like, the matching processing process may be held down to the minimum, whereby the CPU load can be reduced and the reduced portion be assigned to another processing process.

It will be also appreciated that the outputting of a result output, as a recognized output, that the input is different from a registered speaker can be easily performed by use of the control signal of the control section 103.

As apparent by the above embodiment, the present invention has a configuration including a control section which stores a peak signal output from a cepstrum peak detection section in a peak-value memory in response to a mode setting input, or compares the peak signal output from the cepstrum peak detection section with the peak-value memory to supply a second control signal to a matching section, so that, only when the pitch frequency of a voice input is close to a previously registered frequency, the matching operation can be performed, whereby there is an effect that, when a voice other than a registered speaker is inputted, the matching processing is not performed to allow the processing process to be omitted, and a reject result is obtained with a high speed. There is also another effect that, where the device is configured by a microprocessor an the like, the matching processing process may be held down to the minimum, whereby the CPU load can be reduced and the reduced portion be assigned to another processing process, resulting in a rationalized CPU design.

Figure 15:
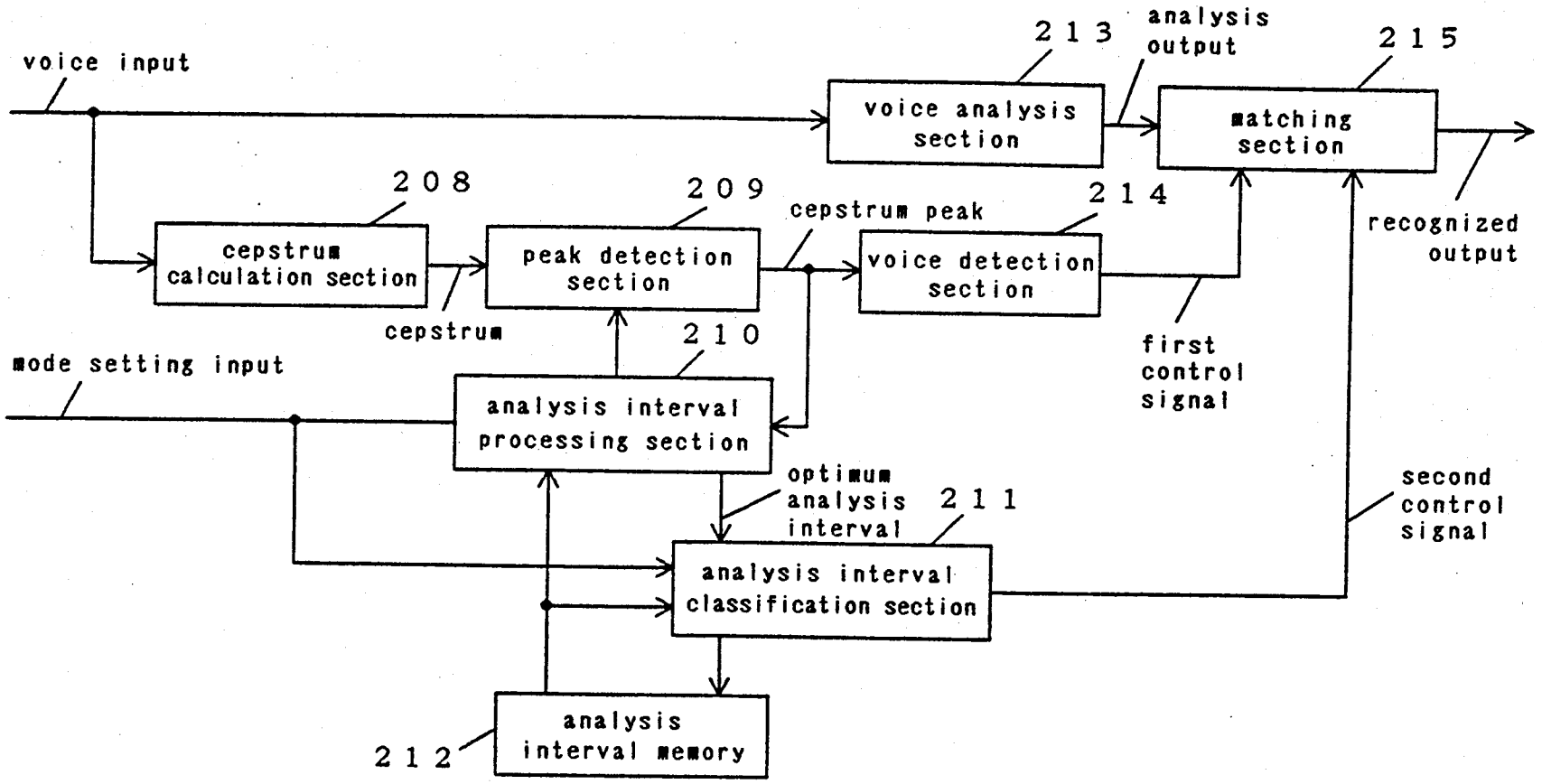
FIG. 15 is a block diagram of another embodiment of the present invention.

Referring to FIG. 15, another embodiment of the present invention will be explained hereinafter.

FIG. 15 is a block diagram of a signal processing device in an embodiment of another present invention. Using FIG. 15, the configuration of the device will be explained below. A cepstrum calculation section 208 calculates a cepstrum from a voice input, and supplies the cepstrum to a peak detection section 209, and the peak detection section 209 detects a peak from the cepstrum, and supplies the peak to an analysis interval processing section 210 and a voice detection section 214. The voice detection section 214 detects the presence/absence of a voice by the cepstrum peak supplied from the peak detection section 209, and supplies a first control signal corresponding to the presence/absence of a voice signal to a matching section 215. The analysis interval processing section 210 sets an optimum analysis interval in response to the cepstrum peak supplied from the peak detection section 209 and supplies the set interval to an analysis interval classification section 211, and also supplies the similar analysis interval data or a predetermined analysis interval data supplied from an analysis interval memory 212 to the peak detection section 209 in response to a mode setting input. The analysis interval classification section 211 compares the optimum analysis interval data supplied from the analysis interval processing section 210 with analysis interval data supplied from the analysis interval memory 212, thereby to perform classification and, in response to the mode setting input, writes or reads the data to or from the analysis interval memory 212 for controlling the analysis interval, and supplies the classified result as a second control signal to the matching section 215. A voice analysis section 213 analyzes the signal input for a data format used in the matching section 215, and supplies the analyzed signal to the matching section 215. The matching section 215 is supplied with the voice input analyzed by the voice analysis section 213, and the first and second control signals from the voice detection section 214 and the analysis interval classification section 211, and, in response to the control signals, checks the analyzed signal supplied from the voice analysis section 105 against a template to obtain a recognized output.

The operation of the device having the above configuration will be explained.

The cepstrum calculation section 208 through the peak detection section 209 detects a cepstrum peak of a voice input, and then the voice detection section 214 is supplied with the cepstrum peak, and detects the presence/absence of a voice. The voice detection section 214 supplies a first control signal to the matching section 215 in response to the presence/absence of a voice. Now, the peak detection section 209 operates in a manner to detect the cepstrum peak according to an analysis interval supplied from the analysis interval processing section 210. At that time, the analysis interval supplied to the peak detection section 209 corresponds to a mode setting input as described later. The voice analysis section 213 analyzes the voice input so that the matching processing can be performed in the matching section 215. Now, consider the operation of the device in the case when the mode setting input is "REGISTRATION", and when the input is "RECOGNITION".

First, when the mode setting input is "REGISTRATION", the analysis interval processing section 210 sets the analysis interval of the peak detection in the peak detection section 209 to a predetermined interval, calculates an analysis interval with a high accuracy in response to the cepstrum peak obtained from the peak detection section 209, and supplies an optimum analysis interval to the analysis interval classification section 211. The analysis interval classification section 211 checks to see if the similar analysis interval to the optimum analysis interval is present in the analysis interval memory 212, and if the interval is not present, stores newly the optimum analysis interval in the analysis interval memory 212, while if the interval is present, composes the optimum analysis interval and the similar analysis interval of the analysis interval memory 212 as described above, and replaces the contents of the analysis interval memory 212 with the composed interval for storing.

Then, when the mode setting input become "RECOGNITION", the analysis interval processing section 210 supplies the data of the previously-supplied analysis interval to the peak detection section 209. The peak detection section 209 detects a peak of a cepstrum in response to a voice input, then the analysis interval processing section 210 calculates an optimum analysis interval in response to the peak, and supplies the calculated interval to the analysis interval classification section 211. The analysis interval classification section 211 checks to see if the similar interval to the optimum analysis interval supplied is present in the analysis interval memory 212, and if the interval is present, supplies the similar analysis interval through the analysis interval processing section 210 to the peak detection section 209 replacing the previously set analysis interval with the similar analysis interval, while if the interval is not present, holds the predetermined analysis interval, and supplies the interval to the peak detection section 209. Further, the section 211 supplies a second control signal indicating the presence/absence of the similar analysis interval to the matching section 215. When a voice is actually present in the voice input, and the analysis interval of the cepstrum peak of the voice input is similar to a previously-registered interval as described above, the matching section 215 performs a matching operation with a template by the first control signal supplied from the voice detection section 214 and by the second control signal supplied from the analysis interval classification section 211.

According to a signal processing device in the embodiment of the present invention as described above, when a voice signal is registered, an analysis interval corresponding to a cepstrum peak corresponding to the pitch frequency indicating the characteristic of a voice is classified and stored in a memory, whereby similar voice inputs within a plurality of registered voice inputs correspond to a composed analysis interval and are stored, while the other voice inputs correspond to individual analysis interval and are stored. In either case, when a voice is to be recognized, the analysis interval corresponding to the cepstrum of an optical voice input is compared with the analysis interval registered in the memory, whereby whether the voice input has been registered or not can be determined. Also, by setting an analysis interval, the analysis processing of the cepstrum peak detection is to be performed at a defined interval, thereby allowing the determination of the presence/absence of a voice input to be performed efficiently and with a high speed. Further, a noise having no cepstrum peak is removed, thereby causing an erroneous operation to be eliminated. Still further, the voice recognition processing is performed after a voice input has been efficiently confirmed and the registration thereof been confirmed as described above, thereby allowing the recognition to be performed as necessary, and the device to be efficiently used.

There is also an effect that, when the device is configured by a microprocessor and the like, a processing operation without waste causes the processing load of the elements thereof to be reduced, thereby allowing many processing to be performed and the configuration to be simplified.

As apparent by the above embodiment, a signal processing device of the present invention having first control signal input means and second control signal input means included in a matching section and for controlling the recognition operation of the matching section which obtains a recognition output using an analyzed output from voice detection means to which a voice signal is inputted, and the device is provided with peak detection means for detecting the peak of a voice signal cepstrum calculated at a specified analysis interval and for outputting the first control signal corresponding to the presence/absence of the voice signal, and provided with means for classifying the analysis interval on the basis of an optimum interval calculated corresponding to the voice input, storing the interval in a memory and supplying the interval to the peak detection section, the means comparing an analysis interval corresponding to an optional voice input with the stored analysis interval in a recognition processing of an optional voice input and outputting the second control signal, and the first and second control signals limiting the recognition processing in a manner to be performed only when a voice signal is present and to be recognized, whereby the recognition processing is performed as necessary, the analysis speed of the cepstrum peak detection is increased by setting an analysis interval, and a noise having no cepstrum peak is removed to cause an erroneous operation to be eliminated. Also, the recognition processing is performed as necessary, thereby allowing the device to be efficiently used.

There is also an effect that a processing operation without waste causes the processing load of the device elements to be reduced, thereby allowing the configuration thereof to be simplified.

It is further understood by those skilled in the art that the foregoing description is preferred embodiments and that various changes and modifications may be made in the invention without departing from the spirit and scope thereof.

What is claimed is:

1. A signal detection device comprising:

cepstrum calculating means for obtaining a cepstrum of a voice signal, mean-value calculation means for making equal the cepstrum output from said cepstrum calculating means;

threshold setting means for setting a voice detection threshold level on the basis of cepstrum mean-value output from said mean-value calculation means, voice detection means to which the cepstrum mean-value output from said mean-value calculation means, cepstrum output from said cepstrum calculating means and a threshold output signal from said threshold setting means are supplied and which detects a voice.

2. A signal detection device in accordance with claim 1, wherein;

said voice detection means compares a cepstrum output exceeding the cepstrum mean-value output with the threshold output signal.

3. A signal detection device in accordance with claim 1, wherein;

said voice detection means has a cepstrum addition section for adding a cepstrum value exceeding the cepstrum mean-value and a comparator for comparing the cepstrum-added output from said cepstrum addition section with the threshold output signal.

4. A signal detection device in accordance with claim 1, wherein said voice detection means has:

an n-set first memory group for storing the cepstrum output, a plurality of n storage spaces in a second memory group for storing the cepstrum mean-value output, a cepstrum addition section for adding first memory output which exceeds output from the second memory set, corresponding to said first memory, and a comparator for comparing cepstrum-added output from said cepstrum addition section with the threshold output signal from said threshold setting means.

5. A signal detection device comprising;

cepstrum calculating means for calculating a cepstrum of voice input, peak detection means for detecting a peak of cepstrum output from said cepstrum calculating means, analysis interval setting means for setting an analysis interval on the basis of peak-detected output from said peak detection means and an operation mode setting signal, and voice detection means to which the peak-detected output from said peak detection means is supplied, for detecting a voice, the peak detection interval of said peak detection means being controlled by set output from said analysis interval setting means.

6. A signal detection device comprising:

cepstrum calculating means for calculating a cepstrum input of voice input, peak detection means for detecting a peak of cepstrum output from said cepstrum calculating means, interval data setting means for setting a frequency interval to be analyzed, on the basis of peak-detected output from said peak detection means, a first memory group to which set output from said interval data setting means is supplied through a first switch, a second memory group for setting previous interval data, a second switch for selecting memory output from said plurality of memory groups, control means for controlling said first and second switches, and voice detection means to which peak-detected output from said peak detection means is supplied, for detecting a voice, a peak detection interval of said peak detection means being controlled by the output from one of said memory groups, selected by said second switch.

7. A signal processing device comprising;

a cepstrum calculation section for inputting therein a voice and calculating a cepstrum, a peak detection section for detecting a peak at a specified analysis interval from a cepstrum calculated by said calculation section, a voice detection section for obtaining a voice-detected output from peak-detected output, an analysis interval setting section for calculating an optimum analysis interval on the basis of said peak-detected output and directing said specified analysis interval to said peak detection section, an analysis interval memory for storing analysis interval information, and an analysis interval classification section for classifying an analysis interval on the basis of said optimum analysis interval and storing a classified analysis interval in said analysis interval memory, said analysis interval being directed by said analysis interval setting section to said peak detection section, and being directed by said analysis interval classification section in response to a mode setting input, and said analysis interval classification section checking said optimum analysis interval against the contents of said analysis interval memory in response to said mode setting input to direct an analysis interval on the basis of said checked result to said analysis interval setting section.

8. A signal control device comprising;

a power calculation section for calculating power in a signal input, a cepstrum calculation section for calculating a cepstrum of said signal input, a peak detection section for detecting a peak of said cepstrum from said cepstrum calculation section, a S/N calculation section for calculating a S/N ratio of said signal input on the basis of output from said power calculation section and output from said peak detection section, a signal detection section for detecting the presence/absence of a signal input on the basis of said output of said peak detection section, and control means for controlling outputting of said signal input by a logical product of output from said S/N calculation section and output from said signal detection section.

9. A signal control device comprising;

a power calculation section for calculating power in a signal input, a cepstrum calculation section for calculating a cepstrum of said signal input, a peak detection section for detecting a peak of said cepstrum from said cepstrum calculation section, a S/N calculation section for calculating a S/N ratio of said signal input on the basis of output from said power calculation section and output from said peak detection section, a signal detection section for detecting the presence/absence of a signal input on the basis of the output of said peak detection section, and a comparator for comparing the output of said power calculation section with a reference level, control means for controlling outputting of said signal input by a logical product of output from said S/N calculation section, the output from said signal detection section and output from said comparator.

10. A signal processing device comprising;

a voice analysis section for analyzing a voice input and outputting an analyzed signal, a matching section for comparing the analyzed signal with a template and outputting a recognized signal, a cepstrum calculation section for calculating a cepstrum from said voice input and outputting a cepstrum, a peak detection section for detecting a peak of said cepstrum and outputting a peak signal, a voice detection section for determining the presence/absence of a voice by said peak signal and outputting a first control signal to said matching section, a control section for outputting a second control signal to said matching section in response to a mode setting input and said peak signal from said peak detection section, and a peak-value memory for storing said peak signal; and said control section controlling writing of said peak signal into said peak-value memory in response to the mode setting input of "SETTING", and controlling comparing of the peak signal of said peak-value memory with the cepstrum peak signal of the voice input in response to the mode setting input of "RECOGNITION", to output said second control signal corresponding to each frequency difference of said compared results, and said matching section being made to output the recognized signal according to said first control signal and said second control signal.

11. A signal processing device comprising;

a voice analysis section for analyzing a voice input and outputting an analyzed signal, a matching section for comparing said analyzed signal with a template and outputting a recognized signal, a cepstrum calculation section for calculating a cepstrum from said voice input and outputting said cepstrum, a peak detection section for detecting a peak of said cepstrum at a specified interval and outputting a peak signal, a voice detection section for determining the presence/absence of a voice by said peak signal and outputting a first control signal to said matching section, an analysis interval processing section for directing said analysis interval to said peak detection section, and calculating an optimum analysis interval corresponding to said cepstrum peak and outputting said optimum analysis interval, an analysis interval memory, an analysis interval classification section for classifying an analysis interval on the basis of said optimum analysis interval and storing said interval in said analysis interval memory, and said analysis interval being directed to said peak detection section by said analysis interval processing section and being directed by said analysis interval classification section in response to the mode of the mode setting input, said analysis interval classification section checking said optimum interval against said analysis interval data of said interval memory in response to said mode setting input to output a second control signal, corresponding to the voice signal to be recognized, to said matching section, and classifying said analysis interval data of said interval memory and directing said analysis interval to said analysis interval processing section, and said matching section utilizing said first and second control signals to limit recognition processing in a manner to be performed only when a voice signal is present and is to be recognized.

* * * * *